United States Patent [19]

Wurzburg

[11] 3,968,005

[45] *July 6, 1976

[54] PAPER SIZING PROCESS USING A REACTION PRODUCT OF MALEIC ANHYDRIDE WITH A VINYLIDENE OLEFIN

[75] Inventor: Otto B. Wurzburg, Whitehouse Station, N.J.

[73] Assignee: National Starch and Chemical Corporation, Bridgewater, N.J.

[ * ] Notice: The portion of the term of this patent subsequent to June 28, 1991, has been disclaimed.

[22] Filed: Apr. 21, 1975

[21] Appl. No.: 569,816

Related U.S. Application Data

[63] Continuation-in-part of Ser. No. 404,595, Oct. 9, 1973, abandoned.

[52] U.S. Cl. ..... 162/158; 162/168 R; 162/168 N; 162/168 NA; 162/174; 162/175; 162/179; 162/181 A

[51] Int. Cl.[2] ..... D21D 3/00

[58] Field of Search..... 162/158, 175, 181 A, 162/179, 174, 168 R, 168 N, 168 NA, 158 R, 158 N; 260/346.8 R, 346.3; 106/213, 127, 140, 151, 158, 199, 210, 243

[56] References Cited

UNITED STATES PATENTS 3,821,069 6/1974 Wurzburg ..... 162/158

*Primary Examiner*—Robert L. Lindsay, Jr.
*Assistant Examiner*—Peter Chin

[57] ABSTRACT

A process of sizing paper with a reaction product of maleic anhydride with a vinylidene olefin.

9 Claims, No Drawings

PAPER SIZING PROCESS USING A REACTION PRODUCT OF MALEIC ANHYDRIDE WITH A VINYLIDENE OLEFIN

This application is a continuation-in-part of application Ser. No. 404,595 filed Oct. 9, 1973, now abandoned.

This invention relates to a process for the sizing of paper and to the improved paper thus prepared. More particularly, this invention relates to novel sizing agents for use in the sizing of paper and paperboard products.

It is the object of this invention to provide improved sizing agents whose use results in the preparation of paper which is characterized by its reduced water and ink absorption as well as its resistance to aqueous acid and alkaline solutions. A further object of this invention involves the use of sizing agents which may be employed with all types of paper pulp over the complete range of pH conditions which are normally encountered in paper manufacturing. An additional object involves the use of sizing agents which are fully compatable with alum and rosin as well as with the various fillers, pigments and other chemicals which may be added to paper.

As used herein, the terms "paper and paperboard" include sheet-like masses and molded products made from fibrous cellulosic materials which may be derived from both natural and synthetic sources. Also included are sheet-like masses and molded products prepared from combination of cellulosic and non-cellulosic materials derived from synthetics such as polyamide, polyester and polyacrylic resin fibers as well as from mineral fibers such as asbestos and glass.

Paper and paperboard are often sized with various materials for the purpose of increasing their resistance to water as well as to other types of aqueous solutions. These materials are referred to as sizes or sizing and they may be introduced during the actual paper making operation wherein the process is known as internal or engine sizing. Or, on the other hand, they may be applied to the surface of the finished web or sheet in which case the process is known as external or surface sizing.

Various water-repellant materials have been utilized as sizing agents. These include rosin, mixtures of rosin with waxes, wax emulsions, ketene dimer emulsions, fluorocarbons, fatty acid complexes of chromium or aluminum chlorides, long chain thermoplastic copolymers, as well as some thermosetting condensation type resins. Although all of these materials are effective under certain conditions, their use is nonetheless subject to one or more limitations.

Thus, for example, in the case of rosin, although the latter is relatively low in cost and readily available, it has poor resistance to alkaline solutions and cannot be used for the sizing of neutral or alkaline pulps. It is inoperable with the latter since it must be ordinarily used in combination with alum or an acidic aluminum ion donor, which is present for the purpose of precipitating and setting the sodium rosinate, i.e. the rosin soap, onto the fibers. The use of alum for this purpose is, however, precluded under neutral or alkaline conditions. This is a definite disadvantage since the paper produced from neutral and alkaline pulp has been found to have higher strength, greater stability and superior aging characteristics in comparison with the paper prepared from acidic pulp. Also, the internal use of alkaline pigments such as calcium carbonate is precluded. This same limitation also applies to the use of most wax emulsions which cannot be used on the alkaline side since they are usually combined with small quantities of alum for the purpose of breaking the emulsions. On the other hand, certain sizing agents will not tolerate appreciable quantities of alum or high acidic conditions. In some cases, it may be desirable or necessary to use alum for filler retention purposes, for increasing sheet drainage, or to retain or set condensation resin additives, etc. Certain sizing agents cannot be adequately retained in the sheet during sheet formation and, consequently, are limited only to external or surface applications.

In addition to the above described pH limitations, the water resistance or water holdout which is attainable with many of the heretofore employed sizing agents is often inadequate for many applications which may require paper or paperboard displaying an exceptionally high degree of water resistance. Moreover, many of these sizing agents have been found to be incompatible with the pigments, fillers, or other ingredients which often are added to paper. A further disadvantage of some sizing agents is that a considerable degree of heat curing is required to develop full effectiveness. Thus, in using these materials, full effectiveness and full sizing value may not be obtained immediately after formation and drying of the paper web.

The use of sizing agents which are substituted cyclic dicarboxylic acid anhydrides has been described in U.S. Pat. No. 3,102,064 patented Aug. 27, 1963 to Wurzburg and Mazzarella and assigned to the assignees of the present application. In that patent the sizing agents correspond to the following structural formula:

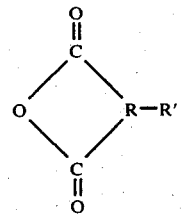

wherein R represents a dimethylene or trimethylene radical and wherein R' is a hydrophobic group containing more than 5 carbon atoms which may be selected from the class consisting of alkyl, alkenyl, aralkyl or aralkenyl groups. Substituted cyclic dicarboxylic acid anhydrides falling within the above described formula are the substituted succinic and glutaric acid anhydrides.

The use of these prior art reagents as sizes for paper and paperboard has been found to result in the preparation of products which display an unusually high degree of water resistance. The successful use of these sizing agents is not restricted to any particular pH range which thus allows for their utilization in the treatment of neutral and alkaline pulp as well as acidic pulp.

The sizing agents described in the aforementioned patent are mainly prepared from linear olefins where the double bond is in the 1,2 or 3-position, or from short chained branched olefins such as triisobutylene. Use of the above classes of olefins leads to sizing agents where the R' group is either linear or linear with multiple methyl or ethyl groups pendant from the linear chain. Alternatively, R' is linear with a pendant methyl, ethyl or propyl group (which group may be saturated or unsaturated) attached to the carbon atom which itself is attached to the cyclic anhydride moiety. Among examples of sizing agents described in the aforementioned patent are included iso-octadecenyl succinic acid anhydride, n-hexadecenyl succinic acid anhydride, dodecenyl succinic acid anhydride, triisobutenyl succinic acid anhydride, etc.

It has now been found that when the cyclic dicarboxylic acid anhydride sizing agent is prepared from a vinylidene olefin corresponding to the following general structure

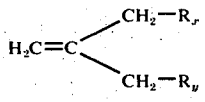

wherein $R_x$ and $R_y$ are alkyl radicals containing at least 5 carbon atoms in each radical, the resultant sizing agent is far more effective (i.e. desired sizing properties are achieved at substantially lower concentrations) than the sizing agents of the prior art which are prepared employing olefins having the double bond in the 1, 2, or 3- position or the short chained branched olefins.

The vinylidene olefins such as defined above are prepared by dimerizing alpha olefins as is known to those skilled in the art.

The sizing agents of the present invention correspond to the following structural formula

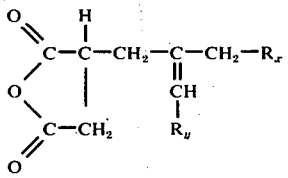

wherein $R_x$ and $R_y$ are as defined above and are interchangeable. Mixtures of the vinylidene olefins may be used in preparing the sizing agents and, of course, mixtures of the above sizing agents may also be employed in the process of this invention.

Examples of sizing agents typical of this invention include sizes prepared by the reaction of maleic acid anhydride with vinylidene olefins such as 2-n-hexyl-1-octene, 2-n-octyl-1-dodecene, 2-n-octyl-1-decene, 2-n-dodecyl-1-octene, 2-n-octyl-1-octene, 2-n-octyl-1-nonene, 2-n-hexyl-1-decene and 2-n-heptyl-1-octene. The sizing agents contemplated herein are non-polymeric.

The preferred vinylidene olefins will contain 14 to 22 carbon atoms but olefins having more than 22 carbon atoms may also be used.

The reaction of certain of these olefins with maleic anhydride will result in producing mixtures of sizing agents. Where large scale uses of commercially supplied olefins are involved, it is noted that such olefins are very often mixtures of related olefins with one or more species being predominant. These olefin mixtures when reacted with the anhydride will also result in producing mixtures of sizing agents. For these reasons the novel sizing agents are not defined hereinafter by their chemical structures but rather are referred to and identified as a reaction product of maleic acid anhydride with a specified olefin which itself may possibly be a mixture. The reaction of maleic acid anhydride with olefins is well known to those skilled in the art.

The novel sizing agents display all of the features and advantages of the cited prior art sizing agents. Moreover, the sizing agents of this invention impart to paper sized therewith a particularly good resistance to acidic liquids such as acid inks, citric acid, lactic acid etc. as compared to paper sized with the sizing agents of the cited prior art. In addition to the properties already mentioned, these sizing agents may also be used in combination with alum as well as with any of the pigments, fillers, and other ingredients which may be added to paper. The sizing agents of the present invention may also be used in conjunction with other sizing agents so as to obtain additive sizing effects. A still further advantage is that they do not detract from the strength of the paper and when used with certain adjuncts will, in fact, increase the strength of the finished sheets. Only mild drying or curing conditions are required to develop full sizing value.

The actual use of these sizing agents in the manufacture of paper is subject to a number of variations in technique any of which may be further modified in light of the specific requirements of the practitioner. It is important to emphasize, however, that with all of these procedures, it is most essential to achieve a uniform dispersal of the sizing agent throughout the fiber slurry, thereby necessitating that its addition to the pulp be accompanied with prolonged and vigorous agitation. Uniform dispersal may also be obtained by adding the sizing agent in a fully dispersed form such as an emulsion; or, by the coaddition of chemical dispersing agents to the fiber slurry.

Another important factor in the effective utilization of the sizing agents of this invention involves their use in conjunction with a material which is either cationic in nature or is, on the other hand, capable of ionizing or dissociating in such a manner as to produce one or more cations or other positively charged moieties. These cationic agents, as they will be hereinafter referred to, have been found useful as a means for aiding in the retention of sizing agents herein as well as for bringing the latter into close proximity to the pulp fibers. Among the materials which may be employed as cationic agents in the process herein one may list alum, aluminum chloride, long chain fatty amines, sodium aluminate, substituted polyacrylamide, chromic sulfate, animal glue, cationic thermosetting resins and polyamide polymers. Of particular interest for use as cationic agents are various cationic starch derivatives including primary, secondary, tertiary or quaternary amine starch derivatives and other cationic nitrogen substituted starch derivatives, as well as cationic sulfonium and phosphonium starch derivatives. Such derivatives may be prepared from all types of starches including corn, tapioca, potato, waxy maize, wheat and rice. Moreover, they may be in their original granule form or they may be converted to pregelatinized, cold water soluble products.

Any of the above noted cationic agents may be added to the stock, i.e. the pulp slurry, either prior to, along with or after the addition of the sizing agent. However, in order to achieve maximum distribution, it is preferable that the cationic agent be added either subsequent to or in direct combination with the sizing agent. The actual addition to the stock of either the cationic agent or the sizing agent may take place at any point in the paper making process prior to the ultimate conversion of the wet pulp into a dry web or sheet. Thus, for example, these sizing agents may be added to the pulp while the latter is in the headbox, beater, hydropulper or stock chest.

In order to obtain good sizing, it is desirable that the sizing agents be uniformly dispersed throughout the fiber slurry in as small a particle size as is possible to obtain. One method for accomplishing this is to emulsify the sizing agent prior to its addition to the stock utilizing either mechanical means, such as high speed agitators, mechanical homogenizers, or by the addition of a suitable emulsifying agent. Where possible, it is highly desirable to employ the cationic agent as the emulsifier and this procedure is particularly successful where cationic starch derivatives are utilized. Among the applicable non-cationic emulsifiers which may be used as emulsifying agents for the sizing agents, one may list such hydrocolloids as ordinary starches, non-cationic starch derivatives, dextrines, carboxymethyl cellulose, gum arabic, gelatin, and polyvinyl alcohols as well as various surfactants. Examples of such surfactants include polyoxyethylene sorbitan trioleate, polyoxyethylene sorbitol hexaoleate, polyoxyethylene sorbitol laurate, and polyoxyethylene sorbitol oleate-laurate. When such noncationic emulsifiers are used, it is often desirable to separately add a cationic agent to the pulp slurry after the addition to the latter of the emulsified sizing agent. In preparing these emulsions with the use of an emulsifier, the latter is usually first dispersed in water and the sizing agent is then introduced along with vigorous agitation.

Further improvements in the water resistance of the paper prepared with these novel sizing agents may be obtained by curing the resulting webs, sheets or molded products. This curing process involves heating the paper at temperatures in the range of from 80° to 150°C. for periods of from 1 to 60 minutes. However, it should again be noted that post curing is not essential to the successful operation of this invention.

The sizing agents of this invention, may, of course, be successfully utilized for the sizing of paper prepared from all types of both cellulosic and combinations of cellulosic with non-cellulosic fibers. The cellulosic fibers which may be used include bleached and unbleached sulfate (kraft), bleached and unbleached sulfite, bleached and unbleached soda, neutral sulfite, semi-chemical chemigroundwood, ground wood, and any combination of these fibers. These designations refer to wood pulp fibers which have been prepared by means of a variety of processes which are used in the pulp and paper industry. In addition, synthetic fibers of the viscose rayon or regenerated cellulose type can also be used.

All types of pigments and fillers may be added to the paper which is to be sized with the novel sizing agents of this invention. Such materials include clay, talc, titanium dioxide, calcium carbonate, calcium sulfate, and diatomaceous earths. Other additives, including alum, as well as other sizing agents, can also be used with these sizing agents.

With respect to proportions, the sizing agents may be employed in amounts ranging from about 0.05 to about 3.0% of the dry weight of the pulp in the finished sheet or web. While amounts in excess of 3% may be used, the benefits of increased sizing properties are usually not economically justified. Within the mentioned range the precise amount of size which is to be used will depend for the most part upon the type of pulp which is being utilized, the specific operating conditions, as well as the particular end use for which the paper is destined. Thus, for example, paper which will require good water resistance or ink holdout will necessitate the use of a higher concentration of sizing agent than paper which will be used in applications where excessive sizing is not needed. The same factors also apply in relation to the amount of cationic agent which may be used in conjunction with these sizing agents. The practitioner will be able to use these materials in any concentration which is found to be applicable to his specific operating conditions. However, under ordinary circumstances a range of from 0.5 to 2.0 parts by weight of cationic agent per 1.0 part of sizing agent is usually adequate. It can be noted that the cationic agent is present in a quantity or at least 0.025% of the dry weight of the pulp in the paper.

The use of the sizing agents of this invention provides a degree of acid water resistance to paper which is substantially higher than is obtained by sizing agents of the prior art and particularly those of U.S. Pat. No. 3,102,064.

The following examples will further illustrate the embodiment of the described invention. In these examples all parts given are by weight unless otherwise noted.

EXAMPLE I

This example illustrates the use of a sizing agent representative of the sizing agents of this invention in the form of an aqueous emulsion wherein the emulsifier used is a tertiary amine cationic starch derivative. The water resistance of the resulting paper is compared with that of paper which had been sized with iso-octadecenyl succinic acid anhydride, a size typical of those described in U.S. Pat. No. 3,102,064.

An aqueous emulsion of a sizing agent comprising the reaction product of maleic anhydride and a vinylidene olefin having 20 carbon atoms was prepared by first cooking 10 parts of the betadiethyl aminoethyl ether of corn starch (whose preparation is described in Example I of U.S. Pat. No. 2,813,093) in 90 parts of water which was heated on a boiling water bath. The dispersion of the cationic starch derivative after being cooked for 20 minutes was cooled to room temperature and transferred to a high speed agitator whereupon 5 parts of the maleic anhydride-vinylidene olefin sizing agent were slowly added to the agitated dispersion. Agitation was continued for about 3 minutes and the resulting emulsion was then diluted with water to equal a total of 1,000 parts (0.5% solids).

Calculated amounts of this stock emulsion were added (diluted with water) to aqueous slurries of bleached sulfate pulp having a freeness of 500, a consistency of 0.5% and a pH of about 7.6 so that the size would be present in concentrations of 0.20 and 0.40% by weight of the dry pulp. Sheets were formed and dried in accordance with TAPPI standards, the basis weight of these sheets being 55 lbs/ream (24 × 360inches — 500 sheets). By means of the same procedure, comparable sheets were made which contained identical amounts of iso-octadecenyl succinic anhydride (abbreviated IODSA) emulsified with the cationic starch derivative described above. Where the sheets were cured, the curing was effected by the use of hot circulating air ovens, 1 hour at 105°C.

In comparing the water resistance of sheets prepared using the maleic anhydride-vinylidene olefin sizing agent with sheets prepared with IODSA, use was made of an acid ink penetration test.

The acid ink penetration test is a comparison test wherein a swatch of paper is floated in a dish of acid ink (pH 1.5) at 100°F. and the time (measured in seconds) required for the ink to penetrate through the paper to reach an end-point where about 50% of the paper is colored is noted.

The following table presents data on the various paper sheets which were compared in the described testing procedure. The sizing agent prepared from the reaction product of maleic anhydride and the vinylidene olefin is designated MA/VO.

Table I

| Sheet No. | Sizing Agent | % by weight of dry pulp | Acid Ink Penetration (time in seconds) Uncured | Cured |
|---|---|---|---|---|
| 1 | MA/VO | 0.2 | 60 | 90 |
| 2 | MA/VO | 0.4 | 140 | 270 |
| 3 | IODSA | 0.2 | 40 | 48 |
| 4 | IODSA | 0.4 | 105 | 245 |

In order to further evaluate the performance of the new vinylidene olefin sizing agents, paper sheets were prepared employing the emulsified sizing agent using the bleached soft wood pulp described above but with the pH of the pulp lowered to 6.0 with alum. For comparison purposes paper sheets utilizing IODSA were also prepared employing the identical procedure. On evaluation of the sheets in the acid ink penetration test, the following results were obtained.

Table II

| Sheet No. | Sizing Agent | % by weight of dry pulp | Acid Ink Penetration (time in seconds) Uncured | Cured |
|---|---|---|---|---|
| 1 | MA/VO | 0.2 | 180 | 240 |
| 2 | MA/VO | 0.4 | 290 | 430 |
| 3 | IODSA | 0.2 | 120 | 150 |
| 4 | IODSA | 0.4 | 150 | 205 |

The above data clearly show that the paper sized with the new vinylidene olefin sizing agent displayed substantially increased resistance to acid penetration measured by the acid ink penetration test as compared to paper sized with IODSA.

EXAMPLE II

This example illustrates the use of another maleic anhydride-vinylidene olefin sizing agent representative of this invention.

In this example the sizing agent was prepared from maleic anhydride and a mixture of vinylidene olefins containing 16, 18 and 20 carbon atoms. The olefin mixture was comprised of about 25% of $C_{16}$ olefin, 25% of $C_{20}$ olefin and 50% of $C_{18}$ olefin. An aqueous emulsion of the sizing agent was prepared by means of the procedure described in Example I wherein the tertiary amine cationic starch derivative described therein was again used as the emulsifier. Calculated amounts of the emulsion were added to separate batches of bleached sulfate pulp having a freeness of 500 and a consistency of 0.5% so as to result in a size concentration of 0.2 and 0.4% by weight of dry pulp. The pH of the pulp slurries was 7.6 and 6.0 (adjusted with alum). Sheets were formed and dried in accordance with TAPPI standards, the basis weight of these sheets being 55 lbs/ream. By means of the same procedure, comparable sheets were made for comparison purposes containing comparable concentrations of IODSA. Where the sheets were cured, the curing was effected by use of hot air for 1 hour at 105°C.

All sheets were tested by the acid ink penetration test described in Example I with the testing results obtained being summarized in Table III.

Table III

| Sheet No. | Sizing Agent | % by weight of dry pulp | Pulp pH | Acid Ink Penetration (time in seconds) Uncured | Cured |
|---|---|---|---|---|---|
| 1 | MA/VO | 0.2 | 7.6 | 32 | 190 |
| 2 | MA/VO | 0.4 | 7.6 | 53 | 600+ |
| 3 | IODSA | 0.2 | 7.6 | 40 | 48 |
| 4 | IODSA | 0.4 | 7.6 | 38 | 85 |
| 5 | MA/VO | 0.2 | 6.0 | 110 | 135 |
| 6 | MA/VO | 0.4 | 6.0 | 190 | 360 |
| 7 | IODSA | 0.2 | 6.0 | 90 | 120 |
| 8 | IODSA | 0.4 | 6.0 | 125 | 160 |

The above results indicate that paper sized with the novel maleic anhydride-vinylidene olefin size have an acid ink resistance generally superior to paper sized with IODSA.

While the novel sizing agents herein have been limited to those prepared by the reaction of maleic acid anhydride with vinylidene olefins, sizing agents may also be prepared using a homologous anhydride, glutaconic acid, together with the identical olefins and be expected to provide similarly effective sizing properties to paper.

In summary, the invention is seen to provide the practitioner with novel sizing agents capable of providing paper products which are characterized by their high degree of acidic water resistance relative to similar sizing agents of the prior art. Variations may be made in proportions, procedures and materials without departing from the scope of this invention.

I claim:

1. The method of sizing paper which comprises the step of intimately dispersing within the wet pulp, prior to the ultimate conversion of said pulp into a dry web, a sizing agent which comprises the non-polymeric reaction product of maleic acid anhydride with a vinylidene olefin corresponding to

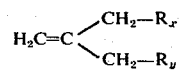

wherein $R_x$ and $R_y$ are alkyl radicals containing at least 5 carbon atoms in each radical.

2. The method of claim 1 in which the sizing agent is in the form of an aqueous emulsion.

3. A paper product having intimately dispersed within the wet pulp thereof, prior to its conversion into a dry web, a sizing agent which comprises the non-polymeric reaction product of maleic acid anhydride with a vinylidene olefin corresponding to -continued

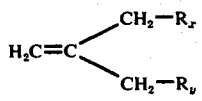

wherein $R_x$ and $R_y$ are alkyl radicals containing at least 5 carbon atoms in each radical.

4. A paper product having intimately dispersed within the wet pulp thereof, prior to its conversion into a dry web, (a) a sizing agent which comprises the non-polymeric reaction product of maleic anhydride with a vinylidene olefin corresponding to

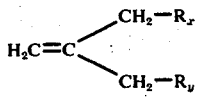

wherein $R_x$ and $R_y$ are alkyl radicals containing at least 5 carbon atoms in each radical, and (b) at least 0.025%, based on the dry weight of the pulp, of a cationic agent.

5. The paper product of claim 4, in which said cationic agent is selected from the group consisting of alum, aluminum chloride, long chain fatty amines, substituted polyacrylamide, animal glue, polyamide polymers, cationic resins and cationic starch derivatives.

6. The method of sizing paper which comprises the steps of intimately dispersing within the wet pulp, prior to the ultimate conversion of said pulp into a dry web, (a) a sizing agent which comprises the non-polymeric reaction product of maleic acid anhydride with a vinylidene olefin corresponding to

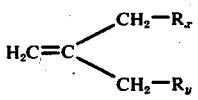

wherein $R_x$ and $R_y$ are alkyl radicals containing at least 5 carbon atoms in each radical, and (b) at least 0.025%, based on the weight of the dry pulp, of a cationic agent.

7. The method of claim 6, in which said cationic agent is selected from the group consisting of alum, aluminum chloride, long chain fatty amines, substituted polyacrylamide, animal glue, polyamide polymers, cationic resins and cationic starch derivatives.

8. The method of claim 6, in which the sizing agent has been emulsified with a surfactant prior to its dispersion within the wet pulp.

9. The method of claim 6, in which the sizing agent is the reaction product of maleic acid anhydride with a mixture of vinylidene olefins of 16–20 carbon atoms.

* * * * *